US010711219B2

(12) United States Patent
Kim et al.

(10) Patent No.: US 10,711,219 B2
(45) Date of Patent: Jul. 14, 2020

(54) AUTOMOTIVE TRANSMISSION FLUID COMPOSITIONS FOR IMPROVED ENERGY EFFICIENCY

(71) Applicant: Infineum international Limited, Abingdon (GB)

(72) Inventors: HahnSoo Kim, Basking Ridge, NJ (US); Laura Kahsar, Rahway, NJ (US)

(73) Assignee: Infineum International Limited (GB)

( * ) Notice: Subject to any disclaimer, the term of this patent is extended or adjusted under 35 U.S.C. 154(b) by 92 days.

(21) Appl. No.: 15/836,990

(22) Filed: Dec. 11, 2017

(65) Prior Publication Data

US 2019/0177638 A1 Jun. 13, 2019

(51) Int. Cl.

| | |
|---|---|
| ***C10M 141/12*** | (2006.01) |
| ***C10M 141/10*** | (2006.01) |
| ***C10M 161/00*** | (2006.01) |
| ***C10M 141/08*** | (2006.01) |

(52) U.S. Cl.

CPC ..... *C10M 141/12* (2013.01); *C10M 141/08* (2013.01); *C10M 141/10* (2013.01); *C10M 161/00* (2013.01); *C10M 2215/223* (2013.01); *C10M 2215/28* (2013.01); *C10M 2219/062* (2013.01); *C10M 2219/066* (2013.01); *C10M 2223/045* (2013.01); *C10M 2227/09* (2013.01); *C10N 2230/06* (2013.01); *C10N 2230/54* (2013.01); *C10N 2240/042* (2013.01); *C10N 2270/02* (2013.01)

(58) Field of Classification Search

USPC ..... 508/363

See application file for complete search history.

(56) References Cited

U.S. PATENT DOCUMENTS

| | | | | |
|---|---|---|---|---|
| 2,719,125 | A | 9/1955 | Roberts | |
| 2,719,126 | A | 9/1955 | Fields | |
| 2,760,933 | A | 8/1956 | Fields | |
| 2,836,564 | A | 5/1958 | Roberts | |
| 3,087,937 | A | 4/1963 | Tesi | |
| 3,254,025 | A | 5/1966 | Le Suer | |
| 3,502,677 | A | 3/1970 | Le Suer | |
| 3,663,561 | A | 5/1972 | Blaha | |
| 4,259,194 | A | 3/1981 | deVries et al. | |
| 4,259,195 | A | 3/1981 | King et al. | |
| 4,261,843 | A | 4/1981 | King et al. | |
| 4,263,152 | A | 4/1981 | King et al. | |
| 4,265,773 | A | 5/1981 | deVries et al. | |
| 4,272,387 | A | 6/1981 | King et al. | |
| 4,283,295 | A | 8/1981 | deVries et al. | |
| 4,285,822 | A | 8/1981 | deVries et al. | |
| 4,857,214 | A | 8/1989 | Papay et al. | |
| 4,873,009 | A | 10/1989 | Anderson | |
| 5,185,090 | A | 2/1993 | Ryer et al. | |
| 5,242,612 | A | 9/1993 | Ryer et al. | |
| 6,143,701 | A * | 11/2000 | Boffa | C10M 129/58 508/363 |
| 2001/0056043 | A1* | 12/2001 | McConnachie | C07F 11/005 508/363 |
| 2013/0005624 | A1* | 1/2013 | Kamano | C10M 141/08 508/258 |

FOREIGN PATENT DOCUMENTS

| | | | | |
|---|---|---|---|---|
| WO | WO-94/06897 | A1 | 3/1994 | |
| WO | WO-9827187 | A1 * | 6/1998 | C10M 141/10 |

OTHER PUBLICATIONS

C.V. Smallheer and R. Kennedy Smith, "Lubricant Additives", The Lezius-Hiles Co., 1967, pp. 1-11.

* cited by examiner

*Primary Examiner* — Ellen M McAvoy
*Assistant Examiner* — Chantel L Graham

(57) ABSTRACT

An automatic transmission fluid comprises a major amount of an oil of lubricating viscosity and minor amounts of (a) one or more oil-soluble or dispersible molybdenum-containing compounds, and (b) a reaction product of an isomerized alkenyl-substituted succinic anhydride and a polyamine characterized by structure (II):

(II)

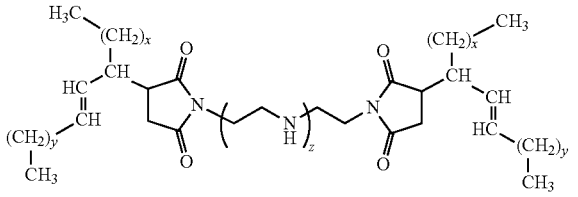

In structure (II) x and y are independently zero or integers from 1 to 30, where x+y is from 1 to 30, and z is zero or an integer from 1 to 10.

15 Claims, No Drawings

AUTOMOTIVE TRANSMISSION FLUID COMPOSITIONS FOR IMPROVED ENERGY EFFICIENCY

The present invention provides automotive transmission fluid compositions having improved power transmission properties through the presence therein of certain defined additives. In particular, the invention provides transmission fluid compositions for automotive vehicles, the use of which increase the fuel efficiency of the vehicle during operation.

In the automotive sector, power transmission occurs primarily through the drive-train components of the vehicle. The crankshaft of the engine is typically coupled to the transmission through some form of clutch, with power transmission occurring across the clutch to drive the transmission and ultimately the road wheels. Further clutches may be present within the transmission depending upon the design of the vehicle and its transmission type. An essential characteristic of such clutches is their ability to efficiently transmit power across the contact between the plates forming the clutch. This contact is primarily contact between the paper surface of a clutch plate and the steel surface of a reaction plate (paper-on-steel contact). For optimum efficiency, it is important that this paper-on-steel contact is a high friction contact such that slippage between the plates, and thus energy loss, is minimized. The fluid used to lubricate the clutch must therefore be able to promote and maintain this high friction, paper-on-steel contact.

In other parts of the transmission, such as gears, contacts are between two or more steel surfaces rather than between steel and paper surfaces. Contrastingly for these steel-on-steel contacts, it is desirable for optimum fuel efficiency to minimize the friction between the contacting surfaces. The fluid used to lubricate the transmission must therefore be able to promote and maintain low friction between contacting steel surfaces.

There are thus competing factors which must be met by the same transmission fluid. On the one hand the fluid must maintain or not adversely impact the high friction of paper-on-steel contacts while on the other, friction in steel-on-steel contacts must be reduced.

It is well known that certain chemical additives can be used to reduce friction in steel-on-steel contacts. These Friction Modifiers, often based on organic compounds such as esters, find widespread use in lubricating oils for engine crank-case applications. However, experiments have shown that these same additives also reduce friction in paper-on-steel contacts making them unsuitable for use in transmission fluids. The present invention is based on the discovery of a combination of chemical additives which when used in an automatic transmission fluid, both reduces steel-on-steel friction and maintains high paper-on-steel friction. This leads to efficient power transmission and reduced energy loss resulting in fuel economy benefits.

Accordingly in a first aspect, the present invention provides an automatic transmission fluid comprising a major amount of an oil of lubricating viscosity and minor amounts of (a) one or more oil-soluble or dispersible molybdenum-containing compounds, and (b) a reaction product of an isomerized alkenyl-substituted succinic anhydride and a polyamine characterized by structure (II):

(II)

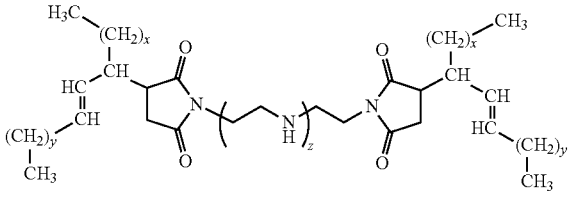

wherein x and y are independently zero or integers from 1 to 30, where x+y is from 1 to 30, and z is zero or an integer from 1 to 10.

In a second aspect, the present invention provides a method of improving the fuel economy of a vehicle equipped with an automatic transmission, the method comprising lubricating the automatic transmission with an automatic transmission fluid according to the first aspect.

In a third aspect, the present invention provides the use of an automatic transmission fluid to improve the fuel efficiency of a vehicle equipped with an automatic transmission, wherein the automatic transmission is lubricated by the automatic transmission fluid, the fluid comprising a major amount of an oil of lubricating viscosity and minor amounts of (a) one or more oil-soluble or dispersible molybdenum-containing compounds, and (b) a reaction product of an isomerized alkenyl-substituted succinic anhydride and a polyamine characterized by structure (II):

(II)

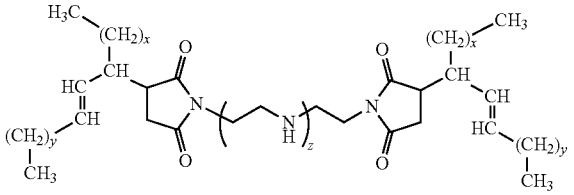

wherein x and y are independently zero or integers from 1 to 30, where x+y is from 1 to 30, and z is zero or an integer from 1 to 10.

In this specification, the following words and expressions, if and when used, have the meanings given below:

- "active ingredients" or "(a.i.)" refers to additive material that is not diluent or solvent;
- "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or any cognate word. The expression "consists essentially of" permits inclusion of substances not materially affecting the characteristics of the composition to which it applies. The expression "consists of" or cognates means only the stated features, steps, integers components or groups thereof are present to which the expression refers;
- "hydrocarbyl" means a chemical group of a compound that contains hydrogen and carbon atoms and that group is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the hydrocarbyl group consists essentially of hydrogen and carbon atoms, unless specified otherwise. More preferably, the hydrocarbyl group consists of hydrogen and carbon atoms, unless specified otherwise. Preferably, the hydrocarbyl group is an aliphatic hydrocarbyl group. The term "hydrocarbyl" includes "alkyl", "alkylene", "alkenyl", "allyl" and "aryl";

"alkyl" means a $C_1$ to $C_{30}$ alkyl group which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"alkylene" is synonymous with "alkanediyl" and means a $C_2$ to $C_{20}$, preferably a $C_2$ to $C_{10}$, more preferably a $C_2$ to $C_6$ bivalent saturated acyclic aliphatic hydrocarbon radical derived from an alkane by removal of a hydrogen atom from two different carbon atoms; it may be linear or branched. Representative examples of alkylene include ethylene (ethanediyl), propylene (propanediyl), butylene (butanediyl), isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"poly(alkylene)" is synonymous with "poly(alkene)" and means a polymer containing the appropriate alkanediyl repeating group. Such polymers may be formed by polymerization of the appropriate alkene (e.g. polyisobutylene may be formed by polymerizing isobutene);

"poly(alkylenyl)" is synonymous with "poly(alkenyl)" and means a polymer substituent group containing the appropriate alkanediyl repeating radical. Suitably, the poly(alkylenyl) substituent group may be formed by reacting the corresponding poly(alkylene) with a reactant (such as maleic anhydride) which introduces a succinic anhydride group onto the poly(alkylene);

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"alkynyl" means a $C_2$ to $C_{30}$, preferably a $C_2$ to $C_{12}$, group which includes at least one carbon to carbon triple bond and is bonded to the remainder of the compound directly via a single carbon atom, and is otherwise defined as "alkyl";

"aryl" means a to $C_6$ to $C_{18}$, preferably $C_6$ to $C_{10}$, aromatic group, optionally substituted by one or more alkyl, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkanol" means an alcohol which consists of an alkyl chain having one or more hydroxyl functional groups bonded to carbon atom(s) of the alkyl chain. The term "alkanol" embraces monohydric alkanols such as methanol, ethanol, propanol and butanol, but also polyhydric alkanols;

"polyhydric alkanol" means an alkanol which includes two or more hydroxyl functional groups. More specifically, the term "polyhydric alkanol" embraces a diol, triol, tetrol, and/or related dimers or chain extended polymers of such compounds. Even more specifically, the term "polyhydric alkanol" embraces glycerol neopentyl glycol, trimethylolethane, trimethylolpropane, trimethylolbutane, pentaerythritol, dipentaerythritol, tripentaerythritol and sorbitol, especially glycerol;

"monocarboxylic acid" means an organic acid, preferably a hydrocarbyl carboxylic acid, which includes a single carboxylic acid functional group;

"aliphatic hydrocarbyl fatty acid" means a monocarboxylic acid having an aliphatic $C_5$ to $C_{29}$, preferably $C_7$ to $C_{29}$, more preferably a $C_9$ to $C_{27}$, most preferably a $C_{11}$ to $C_{23}$ hydrocarbyl chain. Such compounds may be referred to herein as aliphatic ($C_5$ to $C_{29}$), preferably ($C_7$ to $C_{29}$), more preferably ($C_9$ to $C_{27}$), most preferably ($C_{11}$ to $C_{23}$) hydrocarbyl monocarboxylic acid(s) or hydrocarbyl fatty acid(s) (wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e. includes at least one carbon to carbon double bond); preferably, the aliphatic hydrocarbyl chain is unsaturated and includes at least one carbon to carbon double bond—such fatty acids may be obtained from natural sources (e.g. derived from animal or vegetable oils) and/or by reduction of the corresponding saturated fatty acid;

"aliphatic hydrocarbyl fatty acid ester" means an ester wherein the monocarboxylic acid functional group of the aliphatic hydrocarbyl fatty acid, as defined herein, has been converted into an ester group. For example, an aliphatic hydrocarbyl fatty acid ester may be obtained by reacting the corresponding aliphatic hydrocarbyl fatty acid, or reactive derivative thereof (e.g. anhydride or acid halide) with an alkanol, as defined herein. Alternatively, or additionally, the aliphatic hydrocarbyl fatty acid ester may be obtained in its natural fonts e.g. as an aliphatic hydrocarbyl fatty acid glycerol ester. Accordingly, the term "aliphatic hydrocarbyl fatty acid ester" embraces an aliphatic hydrocarbyl fatty acid glycerol ester and also aliphatic hydrocarbyl fatty acid esters obtained by reaction of aliphatic hydrocarbyl fatty acids, or reactive derivatives thereof (e.g. anhydride or acid halide) with an alkanol;

"salicylate soap" means the amount of alkali metal or alkaline earth metal salicylate salt contributed by the one or more alkali metal or alkaline earth metal salicylate detergents) exclusive of any overbasing material;

"alkali metal or alkaline earth metal salicylate detergent" includes salicylate soap as defined herein and any overbasing material;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition expressed in respect of the stated components) and in respect of the total mass of the composition;

"minor amount" means less than 50 mass % of a composition expressed in respect of the stated component(s) and in respect of the total mass of the composition;

"ppm" means parts per million by mass, based on the total mass of the composition;

"metal content" of a composition or of an additive component, for example molybdenum content or total metal content of the additive concentrate (i.e. the sum of all individual metal contents), is measured by ASTM D5185;

"TBN" in relation to an additive component or of a composition, means total base number (mg KOH/g) as measured by ASTM D2896;

"$KV_{40}$" and "$KV_{100}$" mean kinematic viscosity at 40° C. and 100° C. respectively as measured by ASTM D445;

"phosphorus content" is measured by ASTM D5185;

"sulfur content" is measured by ASTM D2622;

"sulfated ash content" is measured by ASTM D874;

$M_n$ means number average molecular weight and for polymeric entities may be determined by gel permeation chromatography with reference to linear polystyrene standards;

$M_w$ means weight average molecular weight and for polymeric entities may be determined by gel permeation chromatography with reference to linear polystyrene standards.

The invention will now be described in more detail where features described herein below are to be understood as applicable to all aspects of the invention.

Oil-Soluble or Dispersible Molybdenum-Containing Compounds (a)

Preferably, the one or more molybdenum-containing compound (a) is present in an amount such as to provide the fluid with between 10 and 1,000 ppm by mass of molybdenum, based on the mass of the fluid. More preferably, the one or more molybdenum-containing compound (a) is present in an amount such as to provide the fluid with between 10 and 500 ppm, for example 50 and 300 ppm by mass of molybdenum, based on the mass of the fluid.

Preferably, the oil-soluble or oil-dispersible molybdenum compound is an oil-soluble or oil-dispersible organo-molybdenum compound. As examples of such organo-molybdenum compounds, there may be mentioned molybdenum dithiocarbamates, molybdenum dithiophosphates, molybdenum dithiophosphinates, molybdenum xanthates, molybdenum thioxanthates, molybdenum sulfides, and the like, and mixtures thereof. Particularly preferred are molybdenum dithiocarbamates, molybdenum dialkyldithiophosphates, molybdenum alkyl xanthates and molybdenum alkylthioxanthates. An especially preferred organo-molybdenum compound is a molybdenum dithiocarbamate. In an embodiment of the present invention any oil-soluble or oil-dispersible molybdenum compound consists of either a molybdenum dithiocarbamate or a molybdenum dithiophohate or a mixture thereof, as the sole source of molybdenum atoms in the composition. In an alternative embodiment of the present invention the oil-soluble or oil-dispersible molybdenum compound consists of a molybdenum dithiocarbamate, as the sole source of molybdenum atoms in the transmission fluid.

The molybdenum compound may be mono-, di-, tri- or tetra-nuclear. Di-nuclear and tri-nuclear molybdenum compounds are preferred.

Suitable dinuclear or dimeric molybdenum dialkyldithiocarbamate are represented by the following formula:

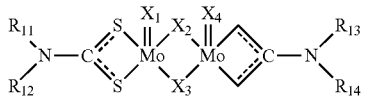

wherein $R_{11}$ to $R_{14}$ independently denote a straight chain, branched chain or aromatic hydrocarbyl group having 1 to 24 carbon atoms; and $X_1$ through $X_4$ independently denote an oxygen atom or a sulfur atom. The four hydrocarbyl groups, $R_{11}$ to $R_{14}$, may be identical or different from one another.

Other molybdenum compounds useful in the fluids of this invention are organo-molybdenum compounds of the formulae $Mo(R_{15}OCS_2)_4$, wherein $R_{15}$ is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Suitable tri-nuclear organo-molybdenum compounds include those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

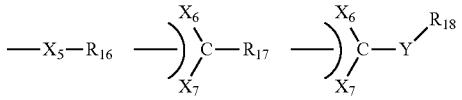

and mixtures thereof, wherein $X_5$, $X_6$, $X_7$, and Y are independently selected from the group of oxygen and sulfur, and wherein $R_{16}$, $R_{17}$, and $R_{18}$ are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

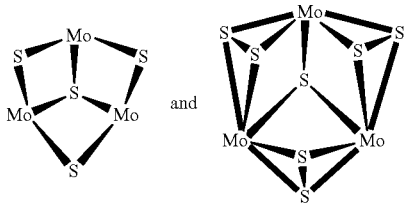

and have net charges of +4. Consequently, in order to solubilize these cores the total charge among all the ligands must be −4. Four mono-anionic ligands are preferred. Without wishing to be bound by any theory, it is believed that two or more tri-nuclear cores may be bound or interconnected by means of one or more ligands and the ligands may be multidentate. This includes the case of a multidentate ligand having multiple connections to a single core. Oxygen and/or selenium may be substituted for sulfur in the core(s).

Oil-soluble or oil-dispersible tri-nuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a tri-nuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

In a particularly preferred embodiment, the one or more oil-soluble or dispersible molybdenum-containing compounds (a) comprises a tri-nuclear molybdenum compound.

A compound's oil solubility or dispersibility may be influenced by the number of carbon atoms in the ligand's organo groups. Preferably, at least 21 total carbon atoms should be present among all the ligands' organo groups. Preferably, the ligand source chosen has a sufficient number of carbon atoms in its organo groups to render the compound soluble or dispersible in the lubricating composition.

Other molybdenum compounds include acidic molybdenum compounds. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/0689.

Reaction Product of an Isomerized Alkenyl-Substituted Succinic Anhydride and a Polyamine (b)

Reaction product (b) has the structure (II):

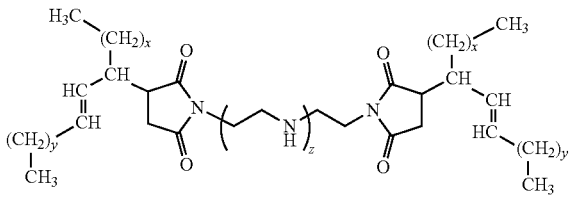

wherein x and y are independently zero or integers from 1 to 30, where x+y is from 1 to 30, and z is zero or an integer from 1 to 10.

Preferably in structure (II) above, x+y is from 8 to 15, and z is zero or an integer from 1 to 5. In a particularly preferred embodiment, x+y=13, and z is 1 or 3.

In an embodiment, reaction product (b) is a mixture of a compound of structure (II) where z is 3 and x+y=13 and a compound of structure (II) where z is 1 and x+y=13.

Preferably, the reaction product (b) is present in the transmission fluid in an amount of 0.5 to 10% by mass, based on the mass of the fluid. More preferably, the reaction product (b) is present in the transmission fluid in an amount of 1 to 7% by mass, for example 2 to 5% by mass based on the mass of the fluid. If reaction product (b) is a mixture of two or more compounds of structure (II), the amount of (b) present refers to the total amount of all compounds of structure (II) present.

Ashless Dispersants (c)

In an embodiment, the automatic transmission fluid of the present invention further comprises at least one ashless dispersant (c).

Suitable as the ashless dispersant are polyisobutenyl succinimides, polyisobutenyl succinamides, mixed ester/amides of polyisobutenyl-substituted succinic acid, hydroxyesters of polyisobutenyl-substituted succinic acid, and Mannich condensation products of hydrocarbyl-substituted phenols, formaldehyde and polyamines. Mixtures of these dispersants can also be used.

Basic nitrogen-containing ashless dispersants are well-known lubricating oil additives and methods for their preparation are extensively described in the patent literature.

Preferred dispersants are the polyisobutenyl succinimides and succinamides where the polyisobutenyl-substituent is a long-chain of preferably greater than 40 carbon atoms. These materials are readily made by reacting a polyisobutenyl-substituted dicarboxylic acid material with a molecule containing amine functionality. Examples of suitable amines are polyamines such as polyalkylene polyamines, hydroxy-substituted polyamines and polyoxyalkylene polyamines. Preferred are polyalkylene polyamines such as tetraethylene pentamine and pentaethylene hexamine. Mixtures where the average number of nitrogen atoms per molecule is greater the 7 are also available. These are commonly called heavy polyamines or H-PAMs. These materials are commercially available under trade names such as "HPA" and "HPA-X" from DowChemical, "E-100" from Huntsman Chemical and others. Examples of hydroxy-substituted polyamines include N-hydroxyalkyl-alkylene polyamines such as N-(2-hydroxyethyl)ethylene diamine, N-(2-hydroxyethyl)piperazine, and N-hydroxyalkylated alkylene diamines of the type described in U.S. Pat. No. 4,873,009. Examples of polyoxyalkylene polyamines typically include polyoxyethylene and polyoxypropylene diamines and triamines having average molecular weights in the range of 200 to 2,500. Products of this type are available under the Jeffamine trade mark.

As is known in the art, reaction of the amine with the polyisobutenyl-substituted dicarboxylic acid material (suitably an alkenyl succinic anhydride or maleic anhydride) is conveniently achieved by heating the reactants together in an oil solution. Reaction temperatures of 100 to 250° C. and reaction times of 1 to 10 hours are typical Reaction ratios can vary considerably but generally from 0.1 to 1.0 equivalents of dicarboxylic acid unit content is used per reactive equivalent of the amine-containing reactant.

Particularly preferred ashless dispersants are the polyisobutenyl succinimides formed from polyisobutenyl succinic anhydride and a polyalkylene polyamine such as tetraethylene pentamine or H-PAM. The polyisobutenyl group is derived from polyisobutene and preferably has a number average molecular weight (Mn) in the range 750 to 5,000, for example 900 to 2,500. As is known in the art, the dispersants may be post treated (e.g. with a boronating agent or an inorganic acid of phosphorus). Suitable examples are given in U.S. Pat. Nos. 3,254,025, 3,502,67 and 4,857,214.

When present, the ashless dispersant is preferably present in an amount of between 0.1 and 10% by mass based on the mass of the transmission fluid, preferably between 0.1 and 5% by mass based on the mass of the transmission fluid, for example between 0.5 and 3% by mass based on the mass of the transmission fluid. A mixture of more than one ashless dispersant may be included in the transmission fluid in which case, the amounts given herein refer to the total amount of the mixture of dispersants used.

In a preferred embodiment, the automatic transmission fluid further comprises between 0.1 and 10% by mass, based on the mass of the transmission fluid, of a polyisobutenyl succimmide ashless dispersant (c) or a mixture of two or more different polyisobutenyl succinimide ashless dispersants (c). More preferably, the automatic transmission fluid further comprises between 0.1 and 5% by mass, such as between 0.5 and 3% by mass based on the mass of the transmission fluid, of a polyisobutenyl succinimide ashless dispersant (c) or a mixture of two or more different polyisobutenyl succinimide ashless dispersants (c). Polyisobutenyl succinimide ashless dispersants (c) may be borated or non-borated, or mixtures thereof.

Oil of Lubricating Viscosity

With regard to all aspects of the invention, the oil of lubricating viscosity may be any suitable lubricating oil as known in the art. Suitable oils are those derived from natural lubricating oils, synthetic lubricating oils, and mixtures thereof.

The oil of lubricating viscosity may be any suitable viscosity but preferable are oils with low viscosities. Typically the oil of lubricating viscosity will have a kinematic viscosity 20 $mm^2/s$ (cSt) at 40° C. or less. Preferred oils of lubricating viscosity have kinematic viscosities of from 20 to 10 $mm^2/s$ (cSt) at 40° C., for example in the range from 14 to 15 $mm^2/s$ (cSt) at 40° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like.

The preferred oils from this class of synthetic oils are Group IV basestocks, i.e. polyalphaolefins (PAO), including hydrogenated oligomers of an alpha-olefin, particularly oligomers of 1-decene, especially those produced by free radical processes, Ziegler catalysis, or cationic catalysis. They may, for example, be oligomers of branched or straight chain alpha-olefins having from 2 to 16 carbon atoms, specific examples being polypropenes, polyisobutenes, poly-1-butenes, poly-1-hexenes, poly-1-octenes and poly-1-decene. Included are homopolymers, interpolymers and mixtures.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000-1500); and mono- and poly-carboxylic esters thereof (e.g., the acetic acid esters, mixed $C_3$-$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dime, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils is adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

The oil of lubricating viscosity may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Another class of suitable oils of lubricating viscosity are those basestocks produced from oligomerization of natural gas feed stocks or isomerization of waxes. These basestocks can be referred to in any number of ways but commonly they are known as Gas-to-Liquid (GTL) or Fischer-Tropsch base stocks.

The oil of lubricating viscosity may be a blend of one or more of the above described oils, and a blend of natural and synthetic lubricating oils (i.e., partially synthetic) is expressly contemplated under this invention.

Co-Additives

Additives commonly found in automatic transmission fluids may be included in the automatic transmission fluid of the present invention. Suitable co-additives will be known to those skilled in the art. Some examples are described in the following passages.

Metal-Containing Detergents

These are well known in the art and widely used in lubricating oils of various types. Examples include oil-soluble neutral or overbased salts of alkali or alkaline earth metals with one or more of the following acidic substances (or mixtures thereof): (1) sulfonic acids, (2) carboxylic acids, (3) salicylic acids, (4) alkyl phenols, (5) sulfurized alkyl phenols. Commonly preferred salts of such acids from the cost-effectiveness, toxicological, and environmental standpoints are the salts of sodium, potassium, lithium, calcium and magnesium.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts.

The term "overbased" in connection with metallic detergents is used to designate metal salts wherein the metal is present in stoichiometrically larger amounts than the organic radical. The commonly employed methods for preparing the over-based salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C.

Examples of common metal-containing detergents used in lubricating oils include, but are not limited to, neutral and overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicylates and magnesium salicylates wherein the aromatic moiety is usually substituted by one or more aliphatic substituents to impart hydrocarbon solubility; the lithium, sodium, potassium, calcium and magnesium salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic substituted cycloaliphatic carboxylic acids; and many other similar alkali and alkaline earth metal salts of oil-soluble organic acids. Mixtures of neutral or over-based salts of two or more different alkali and/or alkaline earth metals are used. Likewise, neutral and/or overbased salts of mixtures of two or more different acids (e.g. one or more overbased calcium phenates with one or more overbased calcium sulfonates) are used.

Methods for the production of oil-soluble neutral and overbased metallic detergents and alkaline earth metal-containing detergents are well known to those skilled in the art, and are extensively reported in the patent literature.

Metal-containing detergents may be boronated. Methods for preparing boronated metallic detergents are well known to those skilled in the art, and are extensively reported in the patent literature.

When present, preferably metal-containing detergents are present in the automatic transmission fluids of the present invention in amounts such as to provide the fluid with between 10 and 1000 ppm by weight of metal, based on the weight of the fluid. More preferably, the automatic transmission fluids of the present invention contains one or more metal-containing detergents in amounts such as to provide the fluid with between 10 and 500 ppm, for example between 50 and 300 ppm, by weight of metal, based on the weight of the fluid. In preferred embodiments, the metal-containing detergent comprises a calcium-containing detergent.

Oil-Soluble Phosphorus Compounds

Oil-soluble phosphorus compound may be any suitable type, and may be a mixture of different compounds. Typically such compounds are used to provide anti-wear protection. The only limitation is that the material be oil-soluble so as to permit its dissolution and transport within the automatic transmission fluid to its site of action. Examples of suitable phosphorus compounds are: phosphites and thiophosphites (mono-alkyl, di-alkyl, tri-alkyl and hydrolyzed or partially hydrolyzed analogues thereof); phosphates and thiophosphates; amines treated with inorganic phosphorus compounds such as phosphorus acid, phosphoric acid or their thio-analogues; amine phosphates. Examples of particularly suitable phosphorus compounds include the mono-, di- and tri-alkyl phosphites represented by the structures:

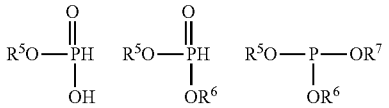

and the tri-alkyl phosphate represented by the structure:

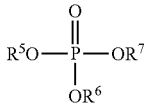

wherein groups $R^5$, $R^6$ and $R^7$ may be the same or different and may be hydrocarbyl groups as defined hereinabove or aryl groups such as phenyl or substituted phenyl. Additionally or alternatively, one or more of the oxygen atoms in the above structures may be replaced by a sulfur atom to provide other suitable phosphorus compounds.

Preferred oil-soluble phosphorus compounds are those where groups $R^5$ and $R^6$ and $R^7$ (when present) are linear alkyl groups such as butyl, octyl, decyl, dodecyl, tetradecyl and octadecyl and in a more preferred embodiment, the corresponding groups containing a thioether linkage. Branched groups are also suitable. Non-limiting examples of compounds include di-butyl phosphite, tri-butyl phosphite, di-2-ethylhexyl phosphite, tri-lauryl phosphite and tri-lauryl-tri-thio phosphite and the corresponding phosphites where the groups $R^5$ and $R^6$ and $R^7$ (when present) are 3-thio-heptyl, 3-thio-nonyl, 3-thio-undecyl, 3-thio-tridecyl, 5-thio-hexadecyl and 8-thio-octadecyl. The most preferred alkyl-phosphites are those described in U.S. Pat. Nos. 5,185,090 and 5,242,612.

While any effective amount of oil-soluble phosphorus compound may be used, typically the amount used will be such as to provide the power transmitting fluid with from 10 to 1000, preferably from 100 to 750, more preferably from 200 to 500 part per million by mass (ppm) of elemental phosphorus, per mass of the fluid.

Corrosion Inhibitors

Corrosion inhibitors are used to reduce the corrosion of metals and are offers alternatively referred to as metal deactivators or metal passivators. Suitable corrosion inhibitors are nitrogen and/or sulfur containing heterocyclic compounds such as triazoles (e.g. benzotriazoles), substituted thiadiadoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A preferred corrosion inhibitor is a benzotriazole represented by the structure:

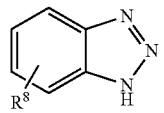

wherein $R^8$ is absent or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O or S. Examples of suitable compounds are benzotriaxole, alkyl-substituted benzotriazoles (e.g. tolyitriazole, ethylbenzotriazole, hexylbenzotriazole, octylbenaotriazole, etc.), aryl substituted benzotriazole and alkylaryl- or arylalkyl-substituted benzotriaxoles. Preferably, the triazole is a benzotriazole or an alkylbenzotriazole in which the alkyl group contains from 1 to about 20 carbon atoms, preferably 1 to about 8 carbon atoms. Benzotriazole and tolyltriazole are particularly preferred.

Another preferred corrosion inhibitor is a substituted thiadiazoles represented by the structure:

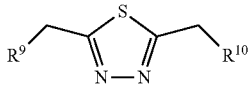

wherein $R^9$ and $R^{10}$ are independently hydrogen or a hydrocarbon group, which group may be aliphatic or aromatic, including cyclic, alicyclic, aralkyl, aryl and alkaryl. These substituted thiadiazoles are derived from the 2,5-dimercapto-1,3,4-thiadiazole (DMTD) molecule. Many derivatives of DMTD have been described in the art, and any such compounds can be included in the transmission fluid used in the present invention. U.S. Pat. Nos. 2,719,125, 2,719,126 and 3,087,937 describe the preparation of various 2,5-bis-hydrocarbon dithio)-1,3,4-thiadiazoles.

Also useful are other derivatives of DMTD. These include the carboxylic esters wherein $R^9$ and $R^{10}$ are joined to the sulfide sulfur atom through a carbonyl group. Preparation of these thioester containing DMTD derivatives is described in U.S. Pat. No. 2,760,933. DMTD derivatives produced by condensation of DMTD with alpha-halogenated aliphatic monocarboxylic carboxylic acids having at least 10 carbon atoms is described in U.S. Pat. No. 2,836,564. This process produces DMTD derivatives wherein $R^9$ and $R^{10}$ are HOOC—CH($R^{19}$)—($R^{19}$ being a hydrocarbyl group).

DMTD derivatives further produced by amidation or esterification of these terminal carboxylic acid groups are also useful.

The preparation of 2-hydrocarbyldithio-5-mercapto-1,3,4-thiadiaxoles is described in U.S. Pat. No. 3,663,561.

A preferred class of DMTD derivatives are the mixtures of the 2-hydrocarbyldithio-5-mercapto-1,3,4-thiadiazoles and the 2,5-bis-hydrocarbyldithio-1,3,4-thiadiaoles. Such mixtures are sold under the trade name Hitec 4313.

Corrosion inhibitors can be used in any effective amount however they are typically used in amounts from about 0.001 to 5.0% by mass based on the mass of the transmission fluid, preferably from 0.005 to 3.0% by mass, most preferably from 0.01 to 1.0 mass %.

Other additives known in the art may be added to the transmission fluids. These include other anti-wear agents, extreme pressure additives, anti-oxidants, viscosity modifiers and the like. They are typically disclosed in, for example, "Lubricant Additives" by C. V. Smallheer and R. Kennedy Smith, 1967, pp 1-11.

The required additives (a) and (b), and if used the optional additives (c) and other additives may be added separately to the oil of lubricating viscosity to form the automatic transmission fluid or more conveniently, they may be added to the oil as an additive concentrate or 'additive package' containing the required compounds dissolved or dispersed in a carrier fluid or solvent. Accordingly in a further aspect, the present invention provides an additive concentrate comprising between 0.1 and 10% by weight of a compound (a) and 5 to 30% by weight of a reaction product (b), both as defined in relation to the first aspect, up to 30% by weight of an ashless dispersant (c), and optionally one or more other additives, the remainder of the concentrate being a carrier fluid or solvent.

As will be well known to those skilled in the art, with regard to the additive concentrate, the carrier fluid or solvent may be any suitable fluid in which the additive may ne readily dissolved or dispersed and which is also compatible with the oil of lubricating viscosity used to form the automatic transmission fluid. Examples include oils of lubricating viscosity as described hereinabove and solvents such as those sold under the Solvesso tradename.

Typically, the additive concentrate will be added to an oil of lubricating viscosity to form the automatic transmission fluid in an amount of between 5 and 50% by weight, based on the weight of the fluid. Preferably, the additive concentrate will be added to an oil of lubricating viscosity to form the automatic transmission fluid in an amount of between 5 and 20% by weight, based on the weight of the fluid.

The invention will now be described by way of non-limiting example only.

Three transmission fluids were prepared as set out in the table below:

| Component | Ex. 1 | Ex. 2 | Comp. |
|---|---|---|---|
| Mo compound (a) (as Mo content) | 200 ppm[(i)] | 100 ppm[(ii)] | not present |
| Reaction product (b) | 2.41 wt %[(iii)]<br>0.22 wt %[(iv)] | 2.41 wt %[(iii)]<br>0.22 wt %[(iv)] | 2.41 wt %[(iii)]<br>0.22 wt %[(iv)] |
| Dispersant (c) | 1.23 wt %[(v)]<br>0.41 wt %[(vi)] | 1.23 wt %[(v)]<br>0.41 wt %[(vi)] | 1.23 wt %[(v)]<br>0.41 wt %[(vi)] |
| Metal-containing detergent (as metal content) | 139 ppm[(vii)] | 139 ppm[(vii)] | 139 ppm[(vii)] |

[(i)]di-nuclear molybdenum dialkyldithiocarbamate (Molyvan ® 822)
[(ii)]tri-nuclear molybdenum dialkyldithiocarbamate
[(iii)]product of structure (II) where z = 1 and x + y = 13
[(iv)]product of structure (II) where z = 3 and x + y = 13
[(v)]borated polyisobutenyl succinimide ashless dispersant
[(vi)]non-borated polyisobutenyl succinimide ashless dispersant
[(vii)]calcium salicylate detergent Ex. 1 and Ex 2. are examples of the present invention and Comp, is a comparative example where no molybdenum compound was used. All examples also included conventional additives commonly found in automatic transmission fluids including corrosion inhibitors, antioxidants extreme pressure/anti-wear additives in the form of oil-soluble phosphorus compounds, and viscosity modifiers. The remainder of each fluid was a mixture of two API Group III base oils.

Each fluid was tested to determine paper-on-steel (POS) static friction and dynamic steel-on-steel (SOS) friction. POS was measured using a D600 fiber plate against an SAE1035 tumbled steel plate on a small scale Low Velocity Friction Appartus (LVFA). The method consists of ramp and static friction measurements after 6, 30 and 60 minutes at 80° C. and 120° C. Static friction at 80° C. and 120° C. were compared between fluids. SOS friction was measured on a Falex block-on-ring apparatus using the JASO M358-2005 method. Friction measurements at 1.00 m/s, 0.25 m/s and 0.025 m/s were compared between the fluids. Results are shown the table below:

| Measurement | Ex. 1 | Ex. 2 | Comp. |
|---|---|---|---|
| POS (80° C.) | 0.111 | 0.106 | 0.109 |
| POS (120° C.) | 0.100 | 0.104 | 0.110 |
| SOS (80° C., 1 m/s) | 0.0897 | 0.0886 | 0.1057 |
| SOS (80° C., 0.25 m/s) | 0.1027 | 0.0851 | 0.1179 |
| SOS (80° C., 0.025 m/s) | 0.1083 | 0.0966 | 0.1238 |
| SOS (110° C., 1 m/s) | 0.0854 | 0.0476 | 0.1167 |
| SOS (110° C., 0.25 m/s) | 0.0875 | 0.0496 | 0.1232 |
| SOS (110° C., 0.025 m/s) | 0.1041 | 0.0539 | 0.1256 |

The results show that the examples of the invention maintained POS friction compared to the comparative example but gave much improved SOS friction. Particularly good SOS friction was achieved using the tri-nuclear molybdenum compound of Ex. 2.

Fluids Ex. 2 and Comp. were also tested in a vehicle using the FTP-75 Fuel Economy test cycle. The vehicle used was a Hyundai Azera Base 3.3 litre V6 (US Model) incorporating a 6-speed transaxle automatic transmission. Results are shown in the table below:

| | Phase I | Phase II | Phase III | FTP-75 |
|---|---|---|---|---|
| Comp | 22.66 MPG | 21.97 MPG | 26.70 MPG | 23.25 MPG |
| Ex. 2 | 22.69 MPG | 22.17 MPG | 27.15 MPG | 23.46 MPG |
| FE improvement | 0.1% | 0.9% | 1.7% | 0.9% |

The overall fuel efficiency gain for Ex. 2 was 0.9%, which is considerably above the 0.2% limit of statistical significance.

What is claimed is:

1. A method of improving the fuel economy of a vehicle equipped with an automatic transmission, the method comprising lubricating the automatic transmission with an automatic transmission fluid comprising a major amount of an oil of lubricating viscosity and minor amounts of (a) one or more oil-soluble or dispersible molybdenum-containing compounds selected from the group consisting of molybdenum dithiocarbamates, molybdenum dialkyldithiophosphates, molybdenum alkyl xanthates, molybdenum alkylthioxanthates, and mixtures thereof, (b) a reaction product of an isomerized alkenyl-substituted succinic anhydride and a polyamine characterized by structure (II):

(II)

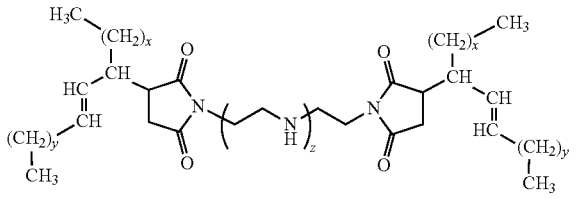

wherein x and y are independently zero or integers from 1 to 30, where x+y is from 1 to 30, and z is zero or an integer from 1 to 10, (c) an ashless dispersant, and (d) a metal-containing detergent, thereby improving fuel economy by at least 0.9% in an FTP-75 test cycle relative to a comparative automatic transmission fluid comprising a major amount of the oil of lubricating viscosity, a minor amount of the reaction product (b), a minor amount of ashless dispersant (c), and a minor amount of metal-containing detergent (d), but no oil-soluble or dispersible molybdenum-containing compound (a), wherein the automatic transmission fluid further exhibits comparable paper-on-steel (POS) friction and significant reduction in steel-on-steel (SOS) friction, relative to the comparative automatic transmission fluid so as to satisfy one or both of the following:

no more than a 3% reduction in static POS friction, measured using a D600 fiber plate against an SAE1035 tumbled steel plate on a small scale Low Velocity Friction Apparatus (LVFA) at about 80° C., relative to the comparative automatic transmission fluid, and no less than a 12% reduction in dynamic SOS friction, measured on a Falex block-on-ring apparatus according to JASO M358-2005 at about 80° C. and at 0.025 to 1.00 m/s; and/or no more than a 9% reduction in static POS friction, measured using a D600 fiber plate against an SAE1035 tumbled steel plate on a small scale LVFA at about 80° C., relative to the comparative automatic transmission fluid, and no less than a 17% reduction in dynamic SOS friction, measured on a Falex block-on-ring apparatus according to JASO M358-2005 at about 110° C. and at 0.025 to 1.00 m/s.

2. A method according to claim 1 wherein the molybdenum-containing compound (a) is present in an amount such as to provide the fluid with between about 10 and about 1,000 parts per million by mass of molybdenum, based on the total mass of the fluid.

3. A method according to claim 1, wherein the reaction product (b) is present in an amount of from about 0.5 to about 10% by mass, based on the total mass of the fluid.

4. A method according to claim 2 wherein the reaction product (b) is present in an amount of from about 0.5 to about 10% by mass, based on the total mass of the fluid.

5. A method according to claim 1 wherein the one or more oil-soluble or dispersible molybdenum-containing compound (a) comprises a tri-nuclear molybdenum compound.

6. A method according to claim 5, wherein the one or more oil-soluble or dispersible molybdenum-containing compound (a) comprises a tri-nuclear molybdenum dialkyldithiocarbamate compound.

7. A method according to claim 1, wherein x+y is from 8 to 15, and z is zero or an integer from 1 to 5.

8. A method according to claim 7, wherein x+y=13, and z is 1 or 3.

9. A method of improving the fuel economy of a vehicle equipped with an automatic transmission, the method comprising lubricating the automatic transmission with an automatic transmission fluid made by diluting, with a major amount of an oil of lubricating viscosity, an additive concentrate comprising between about 0.1 and about 10% by mass, based on the total mass of the concentrate of (a) one or more oil-soluble or dispersible molybdenum-containing compounds selected from the group consisting of molybdenum dithiocarbamates, molybdenum dialkyldithiophosphates, molybdenum alkyl xanthates, molybdenum alkylthioxanthates, and mixtures thereof, from about 5 to about 30% by mass, based on the total mass of the concentrate of (b) a reaction product of an isomerized alkenyl-substituted succinic anhydride and a polyamine characterized by structure (II):

(II)

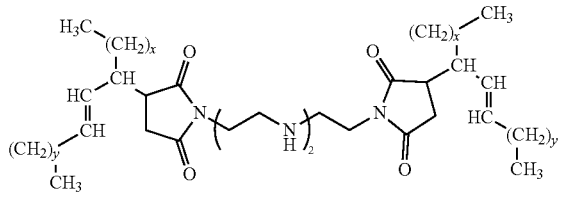

wherein x and y are independently zero or integers from 1 to 30, where x+y is from 1 to 30, and z is zero or an integer from 1 to 10, up to about 30% by mass, based on the total mass of the concentrate of ashless dispersant (c), a metal-containing detergent (d), and optionally one or more other additives;

the remainder of said concentrate being a carrier fluid or solvent, thereby increasing fuel economy of the automatic transmission fluid made from the diluted concentrate in an FTP-75 test cycle by at least 0.9%, relative to a comparative automatic transmission fluid made by diluting, with the oil of lubricating viscosity, the additive concentrate comprising from about 5 to about 30% by mass of the reaction product (b), up to 30% by mass of the ashless dispersant (c), the metal containing detergent (d), and the one or more other optional additives, but no oil-soluble or dispersible molybdenum-containing compound (a), wherein the automatic transmission fluid made from the diluted concentrate further exhibits comparable paper-on-steel (POS) friction and significant reduction in steel-on-steel (SOS) friction, relative to the comparative automatic transmission fluid, so as to satisfy one or both of the following:

no more than a 3% reduction in static POS friction, measured using a D600 fiber plate against an SAE1035 tumbled steel plate on a small scale Low Velocity Friction Apparatus (LVFA) at about 80° C., relative to the comparative, automatic transmission fluid, and no less than a 12% reduction in dynamic SOS friction, measured on a Falex block-on-ring apparatus according to JASO M358-2005 at about 80° C. and at 0.025 to 1.00 m/s; and/or no more than a 9% reduction in static POS friction, measured using a D600 fiber plate against an SAE1035 tumbled steel plate on a small scale LVFA at about 80° C., relative to the comparative automatic transmission fluid, and no less than a 17% reduction in dynamic SOS friction, measured on a Falex block-on-ring apparatus according to JASO M358-2005 at about 110° C. and at 0.025 to 1.00 m/s.

10. A method according to claim 9, wherein the automatic transmission fluid comprises from about 5 to about 50% by mass of the additive concentrate, based on the total mass of the fluid, the remainder being oil of lubricating viscosity.

11. A method according to claim 1, wherein the molybdenum-containing compound (a) is present in an amount such as to provide the fluid with between about 50 and about 300 parts per million by mass of molybdenum, based on the total mass of the fluid.

12. A method according to claim 1, wherein the reaction product (b) is present in an amount of from about 2 to about 5% by mass, based on the total mass of the fluid.

13. A method according to claim 1, wherein the ashless dispersant (c) is present in an amount between about 0.5 to about 3% by mass, based on the total mass of the fluid.

14. A method according to claim 1, wherein the metal-containing detergent (d) is present in an amount so as to provide the fluid with between 10 and 500 ppm by weight of metal, based on the total mass of the fluid.

15. A method according to claim 1, wherein the metal-containing detergent (d) is a calcium-containing detergent.

* * * * *